United States Patent [19]

Brackmann et al.

[11] 4,031,903

[45] June 28, 1977

[54] WINNOWING OF TOBACCO

[75] Inventors: Warren A. Brackmann, Cooksville; Daniel DiIanni, Toronto, both of Canada

[73] Assignee: Rothmans of Pall Mall Canada Limited, Toronto, Canada

[22] Filed: Aug. 29, 1975

[21] Appl. No.: 608,842

[30] Foreign Application Priority Data

Sept. 5, 1974 United Kingdom ..... 38921/74

[52] U.S. Cl. ..... 131/109 B; 131/110

[51] Int. Cl.[2] ..... A24B 1/02; A24C 1/02; A24B 7/14

[58] Field of Search ..... 131/109 R, 109 B, 110, 131/84 C, 84, 108, 61

[56] References Cited

UNITED STATES PATENTS

| | | | |
|---|---|---|---|
| 3,030,965 | 4/1962 | Labbe | 131/61 |
| 3,059,650 | 10/1962 | Gamberini | 131/110 X |
| 3,074,413 | 1/1963 | McArthur | 131/110 X |
| 3,232,297 | 2/1966 | Gamberini | 131/109 R |

*Primary Examiner*—Stephen C. Pellegrino

[57] ABSTRACT

Improved winnowing and tobacco feeder techniques are described. Tobacco particles in substantially separated condition are subjected to air flow transverse to the direction of movement thereof to cause separation of usable tobacco particles from heavy stem and debris, collecting the separated particles on the outer foraminous surface of a vacuum drum and gripping the collected particles to the foraminous surface so that the particles assume the speed of the surface, preferably greater than in the stream subjected to air flow, prior to discharging the gripped particles into a chute as a broad stream of vertically-moving particles, particularly downwardly-moving, from which a filler stream for cigarette formation is collected.

26 Claims, 2 Drawing Figures

FIG. 1
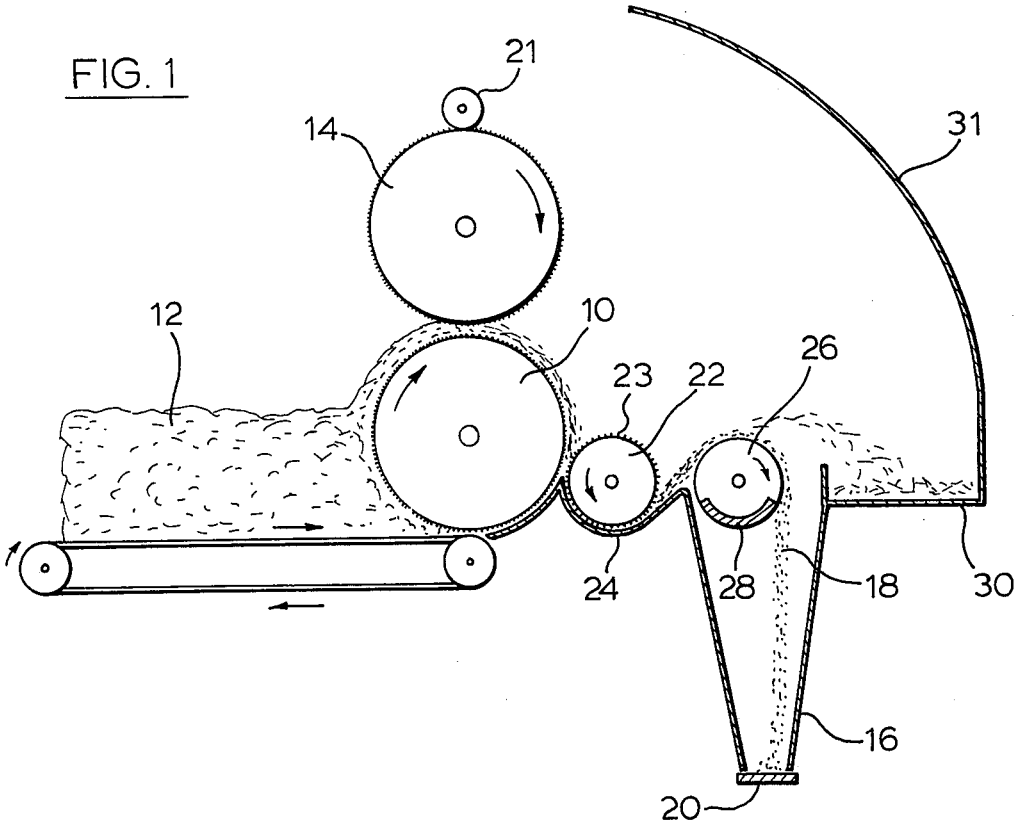
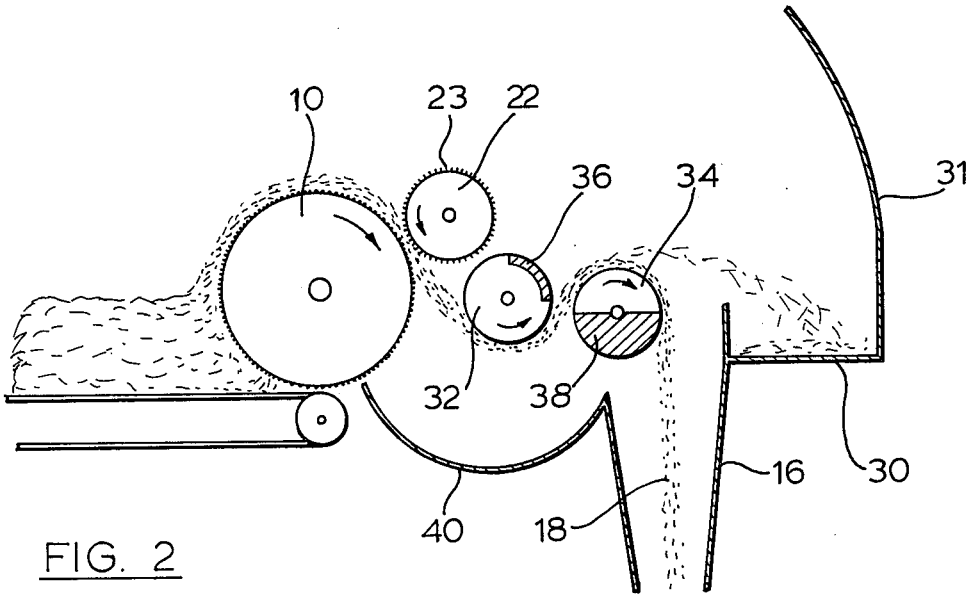
FIG. 2

WINNOWING OF TOBACCO

FIELD OF INVENTION

This invention relates to the winnowing of tobacco and the formation of a broad stream of tobacco particles from which a tobacco filler stream may be formed.

BACKGROUND TO THE INVENTION

In the production of cigarettes, a tobacco filler stream is formed from a broad relatively thin stream of tobacco particles and, after trimming, the filler rod is wrapped in paper to provide a continuous cigarette rod from which individual cigarettes are cut. The tobacco particles which are used to provide the broad stream of tobacco preferably have a narrow range of particle sizes and, in particular, the presence of stem or other heavy debris is usually avoided.

There are two conventional methods of forming the filler stream. In one of these methods, the broad relatively thin stream of tobacco particles is conveyed in a rapidly-moving upwardly-flowing air stream in a confined chute for of narrow depth for collection on a transversely-moving foraminous conveyor. In the other of the methods, the particles in the broad stream are allowed to fall from the end of a feed belt under the influence of gravity onto a transversely-moving conveyor.

In the former method, the tobacco particles are accelerated in the upwardly-moving air stream to result in substantially complete separation of the tobacco particles in the air stream, allowing the formation of a filler stream of substantial uniformity from the separated particles. In contrast, in the latter method, complete separation of the tobacco particles is not ensured and lumps ot tobacco often are present in the downwardly-moving stream, resulting in a less uniform filler stream.

The former method, however, suffers from the drawback that the narrow chute, necessary to achieve the velocity of air flow therethrough, is sensitive to differences in air flow, leading to problems of chute or "chimney" choking, due to accumulation of tobacco paticles therein, thereby necessitating machine shutdown.

In accordance with one aspect of the invention, the formation of a filler stream from a downwardly-moving broad stream of tobacco particles is considerably improved by providing accelerated substantially completely separated tobacco particles in the broad stream, so that the uniformity of the filler stream is at least comparable to that of the cigarette maker using the upwardly-flowing stream of tobacco particles, while the potential problem of chute choking is eliminated and the prior art use of feed belts is avoided.

The tobacco which is fed to the feed mechanism used to produce the broad stream of tobacco consists of cut leaf which contains not only the desired tobacco particles but also some undesirable heavy stem and debris. It is common practice to include some form of winnowing technique to separate the usable tobacco particles from the remainder thereof prior to formation of the broad stream.

In U.S. Pat. No. 3,030,965, which describes the formation of the filler stream from upwardly-moving discrete tobacco particles conveyed by a rapidly-moving air stream confined within a chute by catching the tobacco particles on a foraminous conveyor, the winnowing technique involves picking the tobacco particles at a high rate of speed from a carding drum and passing the particles in a separated condition at a high rate of speed in a direction generally transverse the direction of movement of the broad curtain. Through a confined enclosed area.

The particles desired to form the broad stream are subjected to a centripetal force to cause them to change direction and enter the chute. Those heavy particles whose momentum is too large to be affected significantly by the centripetal force, consisting of stem and other heavy debris, continue in the same path and do not enter the chute.

Air flow is used to apply the centripetal force to the usable particles to cause them to abruptly change their direction to enter the chute wherein they are accelerated by the air flow therethrough to increase their separation one from another, the particles assuming a free flight path from the original direction of movement into the chute by virtue of the air flow across the picked particles into the chute.

The winnowing operation in this prior patent takes place in an enclosed area which confines the stream of picked particles into a narrow passage. The presence of the heavy stem and debris in the stream of picked particles may cause choking of this narrow passage, with consequential machine shut-down.

In accordance with a second aspect of the invention, there is provided a winnowing method for the formation of a vertically-moving broad stream of tobacco particles using air flow which avoids the prior art problems associated with confined areas and the necessity for substantial changes in direction.

A particularly preferred aspect of the invention provides a method for simultaneously winnowing and accelerating tobacco particles for formation of a downwardly-moving broad stream of tobacco particles from which a filler stream may be formed.

SUMMARY OF INVENTION

In the present invention, a stream of separated tobacco particles is subjected to air flow transverse to the direction of movement thereof to attract and grip tobacco particles to a rotating drum or other suitable conveying surface whereon the particles are transported to a discharge point for discharge into the broad stream-confining chute.

BRIEF DESCRIPTION OF DRAWINGS

FIG. 1 is a part-sectional schematic view of a tobacco feeder system in accordance with one embodiment of the invention; and FIG. 2 is a part-sectional schematic view of a tobacco feeder system in accordance with another embodiment of the invention.

DESCRIPTION OF PREFERRED EMBODIMENTS

Considering first the embodiment of FIG. 1, a conventional carding drum 10 feed system is provided for metering tobacco from a mass of tobacco 12 past a refuser roller 14 to provide a uniformly-thick mat of tobacco on the carding drum 10 for feed to a chute 16 to form a downwardly-moving broad stream or curtain 18 of tobacco particles of width substantially that of the mat of tobacco on the carding drum. A filler stream which is manipulated by conventional operations to form cigarettes is formed on a receiving surface 20 from the tobacco particles of the downwardly-moving stream 18.

If desired, a plurality of substream-forming wheels may be positioned between the stream 18 and the receiving surface 20 to subdivide the tobacco particles of the stream 18 into substreams of tobacco from which the filler stream is assembled. This procedure and suitable apparatus are described in U.S. Pat. No. 3,779,252 and U.S. application Ser. No. 562,447 filed Mar. 27, 1975.

A picker roll 22 of any convenient construction having surface picker pins 23 is positioned adjacent the surface of the carding drum 10 at an arcuately-spaced location from the refuser drum 14. The picker roll 22 is mounted for rotation on its axis parallel to the axis of the carding drum 10 and is of an effective length substantially the width of the mat of tobacco on the carding drum 10. The picker roll 22 is positioned so that the picker pins 23 engage the tobacco particles in the mat on the carding drum 10 for removal therefrom.

A camming surface or concave 24 of arcuate cross-section and of length at least equal to that of the picker roll 22 is positioned adjacent the outer surface of the picker roll 22 from the approximate location of closest approach of the picker roll 22 to the carding drum 10 for a portion of its arcuate length, approximately 180°. The camming surface 24 is located in close proximity to the picker roll 22, so that the joint action of the picker roll 22 and the camming surface 24 may convey tobacco particles picked from the carding drum 10.

A vacuum drum 26 is positioned at the upper end of the chute 16. The vacuum drum 26 is an elongate cylinder of effectve length equal to the effective length of the picker roll 22 and has a foraminous air-permeable and tobacco-impermeable surface. Suitable vacuum-inducing means is associated with the vacuum drum 26 to provide a subatmospheric pressure internally of the drum 26 so that vacuum is applied through the foraminous surface and suction air flow is provided exteriorally of the foraminous surface.

A vacuum shoe 28 is located in the vacuum drum 26 to prevent the application of the vacuum over a predetermined arcuate length of the drum 26 so that tobacco particles are not gripped to the drum over that arcuate length.

A catch bin 30 is provided on the opposite side of the chute 16 from the picker roll 22 and has a length at least equal to the width of the picker roll 22. A cover member 31 is provided integral with the rear wall of the catch bin 30 and extending towards the carding drum 10 feed system.

In the operation of the embodiment of FIG. 1, the picker roll 22 is rotated at such a speed as to remove tobacco particles from the mat on the carding drum 10 in a separated condition and impart thereto a substantial speed. The separated tobacco particles are conveyed by the picker roll 20 and the adjacent camming surface 24 to a location where camming surface 24 no longer is adjacent the picker roll 22. The tobacco particles are projected off the camming surface 24 in a flight path towards the cover member 31. The tobacco particles in the flight path pass adjacent to the foraminous surface of the drum 26, typically generally tangentially thereto, and in approximately the same direction of movement at their approach to each other.

The vacuum applied through the foraminous surface causes an air flow transverse to the flight of such a magnitude to attract particles which have the weight-to-surface ratio desired for the particles of the broad stream 18 from the flight path onto the foraminous surface. These attracted particles are gripped and held by the vacuum on the foraminous surface against the centrifugal forces thereof, so that the attracted particles assume the speed of rotation of the drum 26. Dust particles also attracted to the surface pass therethrough for collection.

The particles which are not attracted due to their momentum, or if attracted are not gripped against the centrifugal forces, typically heavier particles, i.e. particles having a greater weight-to-surface area ratio than the desired particles, consisting of stem and other heavy unusable debris, continue in the flight path into the catch bin 30, or similar receptacle, possible after first engaging the cover member 31.

Since the particles gripped on the foraminous surface of the drum 26 assume the speed of rotation of the drum, the particles may be accelerated to any desired speed prior to their release from the foraminous surface. The speed of rotation of the drum 26 is such that the speed of the individual particles imparted by the picker roll 22 is at least maintained, and preferably is increased, so that the tobacco particles on the foraminous surface of the drum 26 remain relatively independent of each other.

The gripped particles are released from the drum 26 when they have been conveyed by the drum 26 to a location in which the particles are moving directly downwardly towards the conveyor 20. The tobacco particles are released from the vacuum grip by the vacuum shoe 28 into the chute 16 and thereupon provide the downwardly-moving particles in the stream 18.

The speed of the particles as they are released from the drum 26 preferably is considerable and in excess of the conventional gravity fed speed of tobacco particles in the chute 16. The tobacco particles in the stream 18 in accordance with one aspect of the invention have a downward component of velocity considerably greater than the velocity in a conventional gravity fed downwardly-moving stream, so that the tobacco particles are in a substantially separated condition upon release from the drum 26, due to the picking operation and the relative speeds of rotation of the picker roll 22 and the drum 26. The broad stream 18, therefore, does not contain the clumps of tobacco conventional in a downwardly-flowing stream operation and hence the advantages of handling separated individual particles in the formation of the filler stream experienced in the upwardly-flowing broad stream system, such as, the improved uniformity of the filler stream collected on the conveyor 20.

However, this aspect of the invention does not require the large volume of conveying gas used in the conventional upwardly-flowing air stream conveyed operation, its associated air handling equipment nor its narrow depth chute. The advantages of the latter method, therefore, are obtained by the present invention without the drawbacks of handling large volumes of gas and the necessity to provide equipment therefor, while narrow passage choking is eliminated. Further, the use of mechanical friction grip on the drum 26 on the particles deflected thereto achieves a more positive separation of tobacco particles one from another than is achieved by the rapid velocity of the air stream in this prior art, hence leading to improvement in the advantages of collection of separated particles.

The apparatus of FIG. 1 also fulfills a second aspect of the invention in providing a simple winnowing technique for the separation of unusable heavy stem and debris from the desired particles from which the broad stream is formed. While this aspect of the invention has been illustrated with reference to a tobacco feeder system in which a downwardly-flowing broad stream is formed, this is a preferred embodiment only and is preferred in view of the fulfilment of the first aspect of the invention by the embodiment of FIG. 1, the winnowing technique may be employed with the upwardly-flowing air stream conveyed system in place of the winnowing technique outline in U.S. Pat. No. 3,030,965 mentioned above.

The fundamental difference between the techniques is that in the present invention all the usable particles are attracted to and gripped on a foraminous surface under the influence of vacuum, thereby allowing acceleration of the particles on the foraminous surface before discharge to the chute, whereas in U.S. Pat. No. 3,030,965, the usable particles are in free flight during abrupt movement from a horizontal to the vertical direction and require to be accelerated in the chute to achieve the desired speed for separation.

Since the particles in the flight path in the stream leaving the surface 24 pass generally tangential to the foraminous surface of the drum 26, the angle through which the usable particles need to be deflected into engagement with the foraminous surface is relatively small, typically about 10°, in contrast with the abrupt 90° turn experienced by the usable particles in the procedure of the aforementioned U.S. Pat. No. 3,030,965.

Further, after deflection onto the foraminous surface in the present invention, the particles are mechanically gripped and conveyed to a discharge point, in contrast to the procedure of U.S. Pat. No. 3,030,965 wherein air flows are used to achieve the winnowing and change in direction, requiring a delicate balance for consistent and effective operation.

The tobacco stream projected into the flight path in this invention is unconfined, in contrast to the operation of the system of U.S. Pat. No. 3,030,965, and hence the choking problems associated therewith in this art, are avoided.

Turning now to the embodiment of Fig. 2, two vacuum drums 32 and 34 are provided, each in the form of an elongate rotating cylinder having a foraminous air-permeable and tobacco-impermeable surface of a length substantially that of the picker roll 22.

A suitable vacuum inducing means is associated with each of the drums 32 and 34 to provide a subatmospheric pressure internally of the drums so that a vacuum is provided through the foraminous surfaces thereof.

A vacuum shoe 36 is located internally of the vacuum drum 32 to prevent the application of vacuum across a selected arcuate length of the foraminous surface.

A vacuum shoe 38 is located internally of the vacuum drum 34 to prevent application of vacuum across a selected arcuate length of the foraminous surface of the drum 34.

A camming surface 24 is not required in this embodiment, although a closure element 40 may be provided.

In the operation of the embodiment of FIG. 2, tobacco is picked from the carding drum 10 by the picker roll 22 as in the case of the embodiment of FIG. 1, but in this case the particles are projected towards the outer surface of the vacuum drum 32, generally tangentially thereto. The projected particles move in substantially the same direction as the adjacent outer surface of drum 32 at their approach to each other. A heavy vacuum is applied internally of the drum 32 at least sufficient to grip and hold all the projected tobacco particles picked from the carding drum 10 on the foraminous surface thereof.

The vacuum shoe 36 situated internally of the drum 32 establishes a vacuum cut-off point which allows the particles on the foraminous surface of the drum 32 to be thrown into a flight path towards the foraminous surface of the drum 34, typically tangentially thereto. The foraminous surface of the drum 34 and the tobacco particles are moving in substantially the same direction as they approach each other.

The heavy vacuum drum 32 thus takes the place of and achieves the same function as the combination of the picker roll 22 and the camming surface 24 in the embodiment of FIG. 1. The vacuum drum 34 then acts in analogous manner to vacuum drum 26 in FIG. 1.

Thus, a lighter vacuum is applied internally of the second drum 34 than that applied to drum 32, the value being sufficient to attract the particles desired for the broad stream 18 from the flight path imparted thereto on release of the vacuum at shoe 40 and to grip and hold the attracted particles against centrifugal forces resulting from the rotation of the drum 34, but insufficient to attract the unwanted debris and stem to the foraminous surfaces against the centrifugal forces. As the drum 34 rotates, therefore, and attracts the usable tobacco particles released from the drum 32, heavy stem or other heavy unusable debris continues in its path and into the catch bin 30.

The usable tobacco particles in contact with the foraminous surface of the drum 34 are released therefrom by the use of the vacuum shoe 38 located so that the tobacco particles are released from the drum 34 when they are moving towards the conveyor 20. The released particles are thrown into the chute 16 to form the broad stream 18.

The speed of rotation of the drums 32 and 34 is such that the speed of the individual particles imparted by the picker roll 22 is maintained by drum 32 and is at least maintained and preferably increased by drum 34, so that the tobacco particles on the foraminous surfaces of the drums 32 and 34 are relatively independent of each other. The additional benefits of accelerating the particles on the drum 34 are discussed above with reference to FIG. 1 and apply with respect to this embodiment.

While the embodiment of FIG. 2 has been described with reference to the formation of a downwardly-flowing broad stream 18 of tobacco, it may be used, with suitable adaptation, to provide an upwardly-moving broad stream in a filler rod-making machine of the type disclosed in U.S. Pat. No. 3,030,965.

SUMMARY

The present invention, therefore, provides improved winnowing and tobacco feed operations, particularly useful in the formation of downwardly-flowing broad streams of tobacco particles from which filler streams may be collected. Modifications are possible within the scope of the invention.

What we claim is:

1. A method for the production from a source of tobacco particles of a relatively wide and thin downwardly-flowing stream of tobacco particles moving at a speed in excess of that achievable by gravitational forces alone, which comprises:

forming from said source a broad stream of tobacco particles of width substantially equal to the width of said downwardly-flowing stream, said tobacco particles in said broad stream flowing at a predetermined speed in substantially separated condition one from another in a flow path intersecting a plane of flow of said downwardly-flowing stream, rotating adjacent to and beneath said broad stream and at the upper end of said downwardly-flowing stream an air-permeable and tobacco-impermeable foraminous cylindrical surface of length substantially equal to the width of said broad stream about its axis parallel to said plane of flow of said downwardly-flowing stream at a peripheral speed at least equal to said predetermined speed and equal to the speed of particles in said downwardly-flowing stream, subjecting the tobacco particles in said broad stream to air flow transverse to the direction of movement thereof towards said foraminous surface by suction air flow applied across said foraminous surface, to deflect tobacco particles from said broad stream into engagement with said foraminous surface, gripping said deflected and engaged particles to said foraminous surface by said suction whereby said gripped particles assume the speed of said foraminous surface and remain in substantially separated condition, transporting said gripped particles on said foraminous surface until the particles are moving in a substantially vertically-downwardly direction, and releasing said transported particles from said suction grip when they are moving in said vertically downwardly direction to form said downwardly-flowing stream of tobacco.

2. The method of claim 1, wherein said broad stream of tobacco particles is formed from said source by transporting tobacco particles from said source as a mat of substantially uniform thickness and width equal to the width of said broad stream, and picking tobacco particles from said mat at a speed equal to said predetermined speed sufficient to separate the picked tobacco particles of said mat one from another.

3. The method of claim 2, wherein said mat is transported on a carded surface of a rotating drum and said picking is achieved using a picker roll rotating adjacent the carded surface on an axis parallel to the axis of said rotating drum and the axis of said foraminous surface, said carded surface and the picker surface of said picker roll moving in the same approximately downward direction at their point of nearest approach to each other.

4. The method of claim 3 including transporting said picked particles on the surface of said picker roll to a location approximately 180° remote from said point of nearest approach with the aid of a camming surface located in close proximity to said picker roll in said 180° and then projecting said latter transported particles into a free flight path towards said plane of flow and constituting said flow path.

5. The method of claim 4 wherein said mat of tobacco particles includes particles of a weight-to-surface area ratio, desired in said downwardly-flowing stream less than a predetermined weight-to-surface area ratio and particles of a weight-to-surface area ratio exceeding said predetermined weight-to-surface area ratio, and said suction air flow and speed of rotation of said foraminous surface are such that only those particles having a weight-to-surface area ratio less than said predetermined weight-to-surface area ratio are gripped to said foraminous surface, transported thereon and released to form said downwardly-flowing stream.

6. The method of claim 5 including allowing said particles of weight-to-surface area ratio exceeding said predetermined weight-to-surface area ratio to remain in said flight path to a location remote from said foraminous surface and on the opposite side of said plane from said foraminous surface, and collecting said latter particles at said remote location.

7. The method of claim 4 wherein said free flight path passes substantially tangential to said foraminous surface.

8. The method of claim 3 including collecting the said picked particles on a second air-permeable and tobacco-impermeable foraminous cylindrical surface of length substantially equal to the length of said picker roll rotating about its axis parallel to the axis of said first-mentioned foraminous surface at a peripheral speed equal to said predetermined speed by suction air flow across said second foraminous surface, transporting said collected tobacco particles on said second foraminous surface to a location adjacent said first-mentioned foraminous surface and releasing the latter transported particles at said latter location into a free flight path towards said plane of flow and constituting said flow path.

9. The method of claim 8 wherein said picked particles form a stream of particles generally tangential to said second foraminous surface and said free flight path passes substantially tangential to the first-mentioned foraminous surface.

10. The method of claim 8 wherein said mat of tobacco particles includes particles of a weight-to-surface ratio desired in said downwardly-flowing stream less than a predetermined weight-to-surface ratio and particles of a weight exceeding said predetermined weight-to-surface ratio, said suction air flow of said second foraminous surface is such that all the picked particles are collected thereon, and said suction air flow and speed of rotation of said first-mentioned foraminous surface are such that only those particles having a weight-to-surface area ratio less than said predetermined weight-to-surface area ratio are gripped to said foraminous surface, transported thereon and released to form said downwardly-flowing stream.

11. The method of claim 10 including allowing said particles of weight-to-surface area ratio exceeding said predetermined weight-to-surface area ratio to remain in said flight path to a location remote from said foraminous surface and on the opposite side of said plane from said foraminous surface, and collecting said latter particles at said remote location.

12. A method of winnowing tobacco in the production of a relatively wide and thin vertically-moving stream of tobacco particles from a source of tobacco particles, which comprises forming from said source a board stream of tobacco particles of width substantially equal to said vertically-moving stream, said tobacco particles in said board stream including tobacco particles of a weight-to-surface area ratio usable in said vertically-moving stream less than a predetermined weight-to-surface area ratio and tobacco particles of a weight-to-surface area ratio exceeding said predetermined weight-to-surface area ratio, said tobacco particles in said broad stream flowing at a predetermined speed in substantially separated condition one from another in a flow path intersecting a plane of flow of said vertically-moving stream, rotating adjacent to said broad stream an air-permeable and tobacco-impermeable foraminous cylindrical surface of length substantially equal to the width of said broad stream about its axis parallel to said plane of flow of said vertically-moving stream at a peripheral speed at least equal to said predetermined speed and equal to the speed of particles in said vertically-moving stream, subjecting the tobacco particles in said broad stream to air flow transverse to the direction of movement thereof towards said foraminous surface by suction air flow applied across said foraminous surface to deflect the tobacco particles of weight-to-surface area ratio less than said predetermined weight-to-surface area ratio from said broad stream into engagement with said foraminous surface, gripping said deflected and engaged particles to said foraminous surface by said suction whereby said gripped particles assume the speed of said cylindrical surface and remain in substantially separated condition, transporting said gripped particles on said foraminous surface until the particles are moving in a substantially vertical direction which is the same direction as the direction of movement of said vertically-moving stream, releasing said transported particles from said suction grip when they are moving in said substantially vertical direction to form said vertically-moving stream of tobacco containing only particles of less than said predetermined weight-to-surface area ratio, and allowing said particles of weight-to-surface area ratio exceeding said predetermined weight-to-surface area ratio to remain in said flow path to a location remote from said foraminous surface.

13. The method of claim 12, wherein said vertically-moving stream is moving vertically downwardly.

14. The method of claim 13, wherein said broad stream of tobacco particles is formed from said source by transporting tobacco particles from said source as a mat of substantially uniform thickness and width equal to the width of said broad stream, and picking tobacco particles from said mat to a speed equal to said predetermined speed sufficient to separate the picked tobacco particles of said mat one from another.

15. The method of claim 14, wherein said mat is transported on a carded surface of a rotating drum and said picking is achieved using a picker roll rotating adjacent the carded surface on an axis parallel to the axis of said rotating drum and the axis of said foraminous surface, said carded surface and the picker surface of said picker roll moving in the same approximately downward direction at their point of nearest approach to each other.

16. The method of claim 15, including transporting said picked particles on the surface of said picker roll to a location approximately 180° remote from said point of nearest approach with the aid of a camming surface located in close proximity to said picker roll in said 180° and then projecting said latter transported particles into a free flight path towards said plane of flow and constituting said flow path.

17. The method of claim 16 wherein said remote location is on the opposite side of said plane from said foraminous surface, and including collecting said latter particles at said remote location.

18. The method of claim 17 including collecting the said picked particles on a second air-permeable and tobacco-impermeable foraminous cylindrical surface of length substantially equal to the length of said picker roll rotating about its axis parallel to the axis of said first-mentioned foraminous surface at a peripheral speed equal to said predetermined speed by suction air flow across said second foraminous surface, transporting said collected tobacco particles on said second foraminous surface to a location adjacent said first-mentioned foraminous surface and releasing the latter transported particles at said latter location into a free flight path towards said plane of flow and constituting said flow path.

19. The method of claim 18 wherein said picked particles form a stream of particles generally tangential to said second foraminous surface and said free flight path passes substantially tangential to said first-mentioned foraminous surface.

20. The method of claim 19, wherein said remote location is on the opposite side of said plane from said foraminous surface, and including collecting said latter particles at said remote location.

21. The method of claim 15 wherein said free flight path passes substantially tangential to said foraminous surface.

22. A tobacco stream forming and winnowing apparatus comprising:

a source of tobacco particles of varying weight-to-surface area ratios above and below a predetermined weight-to-surface area ratio, carding drum means of effective length equal to the width of tobacco steam required and mounted for rotation about a horizontal axis adjacent said source of tobacco particles, metering means associated with said carding drum means for controlling the thickness of a mat of tobacco particles formed on said carding drum means from said source of tobacco particles, picker roll means of effective length equal to the effective length of said carding means mounted adjacent the periphery of said carding drum means at a location arcuately spaced from said source of tobacco particles a greater distance than said metering means in tobacco particle-picking relationship to said carding drum means for rotation about an axis parallel to the axis of the carding drum means and in a direction such that in said tobacco particle-picking relationship the adjacent surfaces of said carding drum means and said picker roll means move in the same direction and at such a speed as to pick tobacco particles from said mat on said carding drum means in substantially separated condition, tobacco stream forming means associated with said picker roll means to form from said picked tobacco particles a broad stream of tobacco particles of width the same as the effective width of said picker roll means moving in a flow path extending acute angularly upwardly with respect to the horizontal and in which the tobacco particles remain in a substantially separated condition, vacuum drum means located adjacent said tobacco stream forming means and beneath said flow path for receiving tobacco particles from said broad stream, said vacuum drum means including an air-permeable and tobacco-impermeable foraminous cylindrical surface of length substantially equal to the effective length of said carding drum means rotatable about an axis parallel to said axis of said carding drum means, vacuum inducing means associated with said vacuum drum means for subjecting the interior of said drum means to subatmospheric pressure and cause suction air flow across said foraminous surface sufficient to deflect tobacco particles from said board stream into contact with said foraminous surface and to grip tobacco particles of a weight-to-surface area ratio less than said predetermined weight-to-surface area ratio to said foraminous surface and to transport said gripped particles thereon while subjected to centrifugal forces due to rotation of said foraminous surface but insufficient to grip and transport tobacco particles of a weight-to-surface area ratio greater than said predetermined weight-to-surface area ratio, whereby winnowing is achieved, vacuum interrupting means associated with said foraminous surface for preventing said suction air flow over a selected arcuate length of said foraminous surface and positioned to release said gripped and transported particles therefrom when said particles are travelling substantially vertically downwardly, chute means extending downwardly from said foraminous surface for receiving said released downwardly-travelling particles as a relatively wide and thin downwardly-moving stream of tobacco particles, and tobacco gathering means located at the lower end of said chute means for forming an elongate narrow tobacco filler stream from said downwardly-moving stream of tobacco particles.

23. The apparatus of claim 22 including tobacco particle catch means mounted to said chute means on the opposite side thereof from said carding drum means.

24. The apparatus of claim 23 wherein said carding drum means and said picker roll means are arranged so that in said tobacco particle-picking relationship at their point of closest approach they are moving generally downwardly.

25. The apparatus of claim 24, wherein said tobacco stream forming means includes an elongate cam surface of arcuate cross section located adjacent the outer surface of said picker roll means and extending from said point of closest approach through about 180°, whereby said picked tobacco particles are transported by the combined action of said picker roll means and said cam surface and projected into a flight path corresponding to said flow path at the end of said cam surface, and said vacuum drum means is positioned so that said flight path extends generally tangentially to said foraminous surface.

26. The apparatus of claim 24 wherein said tobacco stream forming means includes a second vacuum drum means located between said picker roll means and said first-mentioned vacuum drum means for receiving said tobacco particles picked by said picker roll means, said second vacuum drum means including an air-permeable and tobacco-impermeable foraminous cylindrical surface of length substantially equal to the effective length of said carding drum means rotatable about an axis parallel to said axis of said carding drum means, second vacuum inducing means associated with said second vacuum drum means for subjecting the interior of said second vacuum drum means to subatmospheric pressure and cause suction air flow across said second foraminous surface sufficient to collect all said picked tobacco particles on said second foraminous surface and transport the same thereon, and second vacuum interrupting means associated with said second foraminous surface for preventing said suction air flow over a selected arcuate length of said foraminous surface and positioned to release transported tobacco particles therefrom, said second vacuum interrupting means being positioned to release all said collected and transported tobacco particles into a flight path corresponding to said flow path, said first-mentioned foraminous surface being positioned so that the flight path extends generally tangentially thereto.

* * * * *